US006085837A

United States Patent [19]

Massinon et al.

[11] Patent Number: 6,085,837

[45] Date of Patent: Jul. 11, 2000

[54] DOWNHOLE FLUID DISPOSAL TOOL AND METHOD

[75] Inventors: Roland Massinon, Dewinton; David A. Hill, Bragg Creek; Colin A. Aldridge, Okotoks, all of Canada

[73] Assignee: Kudu Industries Inc., Calgary, Canada

[21] Appl. No.: 09/056,697

[22] Filed: Apr. 8, 1998

[30] Foreign Application Priority Data

Mar. 19, 1998 [CA] Canada ..... 2,232,748

[51] Int. Cl.[7] ..... E21B 43/34

[52] U.S. Cl. ..... 166/265; 166/106

[58] Field of Search ..... 166/313, 106, 166/105, 242.1, 265

[56] References Cited

U.S. PATENT DOCUMENTS

| | | | |
|---|---|---|---|
| 3,323,361 | 6/1967 | Lebourg | 73/152.23 |
| 4,596,271 | 6/1986 | Brundage | 137/540 |
| 4,805,697 | 2/1989 | Fouillout et al. | 166/265 |
| 4,905,760 | 3/1990 | Gray | 166/68 |
| 5,176,216 | 1/1993 | Slater . | |
| 5,899,270 | 5/1999 | Watson | 166/105.5 |

*Primary Examiner*—David Bagnell
*Assistant Examiner*—Zakiya Walker
*Attorney, Agent, or Firm*—Bennett Jones

[57] ABSTRACT

A downhole tool is described can be used for handling waste fluids separated from desired hydrocarbon production fluids. The waste fluids are injected into a disposal formation. The tool is produced to avoid blockage of fluid flow passages and to reduce or eliminate the creation of a pressure differential across the tool. The tool is adaptable to be used with various sizes of pumps, to accommodate various pump intake filters and to conform to API tolerances. The downhole tool includes: an inner tube having a longitudinal bore, a seal disposed at the lower end of the longitudinal bore, an outer tube having an outer surface and being disposed about and spaced from the inner tube. An annulus is formed between the inner tube and the outer tube and is open at each end. A threaded connection is formed at the upper end of the outer tube to connect the outer tube to a tubing string such that the annulus opens into the tubing string's longitudinal bore. A transverse port extends to provide access between the longitudinal bore of the inner tube and the outer surface of the outer tube without opening into the annulus.

35 Claims, 4 Drawing Sheets

DOWNHOLE FLUID DISPOSAL TOOL AND METHOD

FIELD OF THE INVENTION

This invention is directed to a downhole tool and method for use thereof and, in particular, a tool and method for downhole injection.

BACKGROUND OF THE INVENTION

In the production of oil and/or gas, sometimes a heavier fluid is produced with the desired hydrocarbon fluid. This heavier fluid must be separated from the oil and/or gas and disposed of.

Preferably, the undesired heavier fluids are separated from the desired hydrocarbon fluids downhole and are injected into a disposal formation without being brought to ground surface.

An injection tool is disclosed in U.S. Pat. No. 5,176,216 of Slater et al. The tool which is disclosed handles the heavier fluids after they have been separated by residence time downhole from the lighter hydrocarbon fluids. The tool allows the heavier fluids to move further down the well into a disposal formation. The tool includes a portion for accepting and sealing with a pump and has inlet ports through which the heavier liquids flow into the tool and thereby into a pump secured to the tool. A plurality of injection ports are provided through which liquid from the pump is injected into the disposal formation.

The tool of Slater is of limited use, however, as the ports to the disposal formation are of very small diameter and, therefore, are easily plugged, are susceptibel to erosion and also cause a pressure differential through the tool. In addition, the tool is formed to only accept non-standard sizes of mandrels and cups.

SUMMARY OF THE INVENTION

A downhole tool has been invented which can be used for handling waste fluids which have been separated from desired hydrocarbon production fluids. The waste fluids are injected into a disposal formation. The tool is produced to avoid blockage of fluid flow passages and to reduce or eliminate the creation of a pressure differential across the tool. The tool is adaptable to be used with various sizes of pumps, to accommodate various pump intake filters and to conform to API tolerances.

In accordance with a broad aspect of the present invention, there is provided a downhole tool comprising: an inner tube having a longitudinal bore, a seal disposed at the lower end of the longitudinal bore, an outer tube having an outer surface and being attached about and spaced from the inner tube; an annulus formed between the inner tube and the outer tube and being open at each end; means at the upper end of the outer tube to connect the outer tube to a tubing string such that the annulus opens into the tubing string's longitudinal bore and a transverse port extending to provide access between the longitudinal bore of the inner tube and the outer surface of the outer tube without opening into the annulus.

The seal in the longitudinal bore can be any suitable means for sealing the bore such as an end wall formed integral with the inner tube or a plug secured in the bore of the inner tube.

A coating of non-stick and/or erosion resistant material can be applied to at least some of the surfaces of the tool and, preferably, at least those surfaces defining the transverse port, the longitudinal bore of the inner tube and the annulus. A particularly preferred coating material is a polymer such as a fluoropolymer, for example, one known as Impreglon™.

Thus, in accordance with another broad aspect of the present invention, there is provided a downhole tool comprising: a tubular member having at least one unobstructed longitudinal conduit extending in the wall thereof from one end of the tubular member to the other and at least one transverse port extending through the wall of the tubular member without intercepting any longitudinal conduit; means to connect the tubular member to a tubing section wherein the at least one longitudinal conduit opens at one end into the tubing section's inner bore and a seal at one end of the tubular member, the improvement comprising: a coating of non-stick and/or erosion resistant material applied to at least some of the surfaces of the tool.

Preferably, the coating material is applied to all of the surfaces of the tool or at least those surfaces defining the transverse port, the longitudinal bore of the inner tube and the annulus. A particularly preferred coating material is a polymer such as a fluoropolymer, for example, Impreglon™.

For use in injection, a pump is attached to the tool so that the pump is in communication with the bore of the inner tube. In one embodiment, the tool can be used with a pump having an intake filter attached thereto. In this embodiment, the inner tube is preferably selected to have a length suitable for accommodating the pump filter therein. Generally, the inner tube has a length of about 6 to 12 inches from the end seal to the upper edge of the tube.

In another embodiment, the inner tube of the tool has means for engagement to a pump such as, for example, a threaded portion or a J-lock arrangement for engagement to a corresponding threaded portion or J-lock portion on the pump.

It may be desirable to use the same tool for many applications. Thus, it is desirable that the tool be able to be modified for use in many applications and, for example, with various sizes of pumps or pump hold down apparatus, with various pump attachment means and with or without pump intake filters. Most of the variations for use in different applications requires changes to be made to the inner tube. Thus, in one embodiment, at least a portion of the inner tube is removable and, thereby, replaceable. In particular, preferably the inner tube is formed of an upper inner tube and a lower inner tube, the upper inner tube and the lower inner tube being connectable to form a fluid tight seal therebetween and the upper inner tube being removable from the remainder of the tool. There can be many forms of the upper inner tube to suit the use to which the tool is to be put. As an example, the upper inner tube can be formed for accepting a pump and can have a formed thereon a means for connection to a pump such as a threaded portion or a J-lock arrangement.

In another embodiment, the outer tube is also formed as two parts: an upper outer tube and a lower outer tube. Preferably, the upper outer tube is releasably connected to the lower outer tube being connectable to form a fluid tight seal therebetween and the upper outer tube being removable from the remainder of the tool.

To facilitate use of the tool with some pump types, in one embodiment the tool includes a valve mounted on the tool to regulate the flow of fluid out of the annulus.

In another embodiment, the minimum cross sectional area of the annulus is selected to correspond to the discharge area of the pump which is used with the tool.

In accordance with another broad aspect of the present invention, there is provided a downhole tool comprising: a tubular member having at least one unobstructed longitudinal conduit extending in the wall thereof from one end of the tubular member to the other and at least one transverse port extending through the wall of the tubular member without intercepting any longitudinal conduit; means to connect the tubular member to a tubing section wherein the at least one longitudinal conduit opens at one end into the tubing section's inner bore and a seal at one end of the tubular member, the improvement comprising: the tool including a valve positioned to regulate the flow of fluid through the at least one longitudinal conduit.

Preferably, the valve is mounted on the tool and adjacent the outlet of the longitudinal conduit. The valve can be positioned at any location on the tool provided it is capable of regulating flow through the bottom end of the longitudinal conduit. Preferably, the valve is mounted on the tool at the bottom end thereof.

In accordance with another broad aspect of the present invention, there is provided a downhole injection assembly for passing waste fluids through a well borehole from a production layer to a disposal layer, the well borehole having a wall extending from surface, the assembly comprising; a tool including an inner tube having a longitudinal bore, a seal disposed at the lower end of the longitudinal bore, an outer tube having an outer surface and being mounted about and spaced from the inner tube; an annulus formed between the inner tube and the outer tube and being open at each end; means at the upper end of the outer tube to connect the outer tube to a tubing string such that the annulus opens into the tubing string's longitudinal bore and a transverse port extending to provide access between the longitudinal bore of the inner tube and the outer surface of the outer tube without opening into the annulus; a tubing string connected to the upper end of the outer tube; and a pump, having a known discharge area, in pumping communication with the longitudinal bore of the inner tube.

In accordance with yet another broad aspect of the present invention there is provided a method for passing waste fluids through a well borehole from a production layer to a disposal layer, the well borehole having a wall extending from surface, comprising; providing a downhole tool including an inner tube having a longitudinal bore, a seal disposed at the lower end of the longitudinal bore, an outer tube having an outer surface and being mounted about and spaced from the inner tube; an annulus formed between the inner tube and the outer tube and being open at each end; means at the upper end of the outer tube to connect the outer tube to a tubing string such that the annulus opens into the tubing string's longitudinal bore and a transverse port extending to provide access between the longitudinal bore of the inner tube and the outer surface of the outer tube without opening into the annulus; connecting the outer tube to a tubing string; placing a pump in pumping communication with the longitudinal bore of the inner tube; positioning the tool, tubing section and the pump in the borehole such that the tool is in pumping communication with waste fluids passing from the production zone; setting a sealing means about the tool between the transverse port and the lower opening to the annulus; activating the pump to move waste fluids in through the transverse port and through the inner tube bore.

The well borehole wall can be the wall in an uncompleted well or the casing forming the wall of a cased well. The sealing means can be attached to the tool or can be mounted on an extension tube attached to and extending below the outer tube.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DETAILED DESCRIPTION OF THE PRESENT INVENTION

Figure 1:
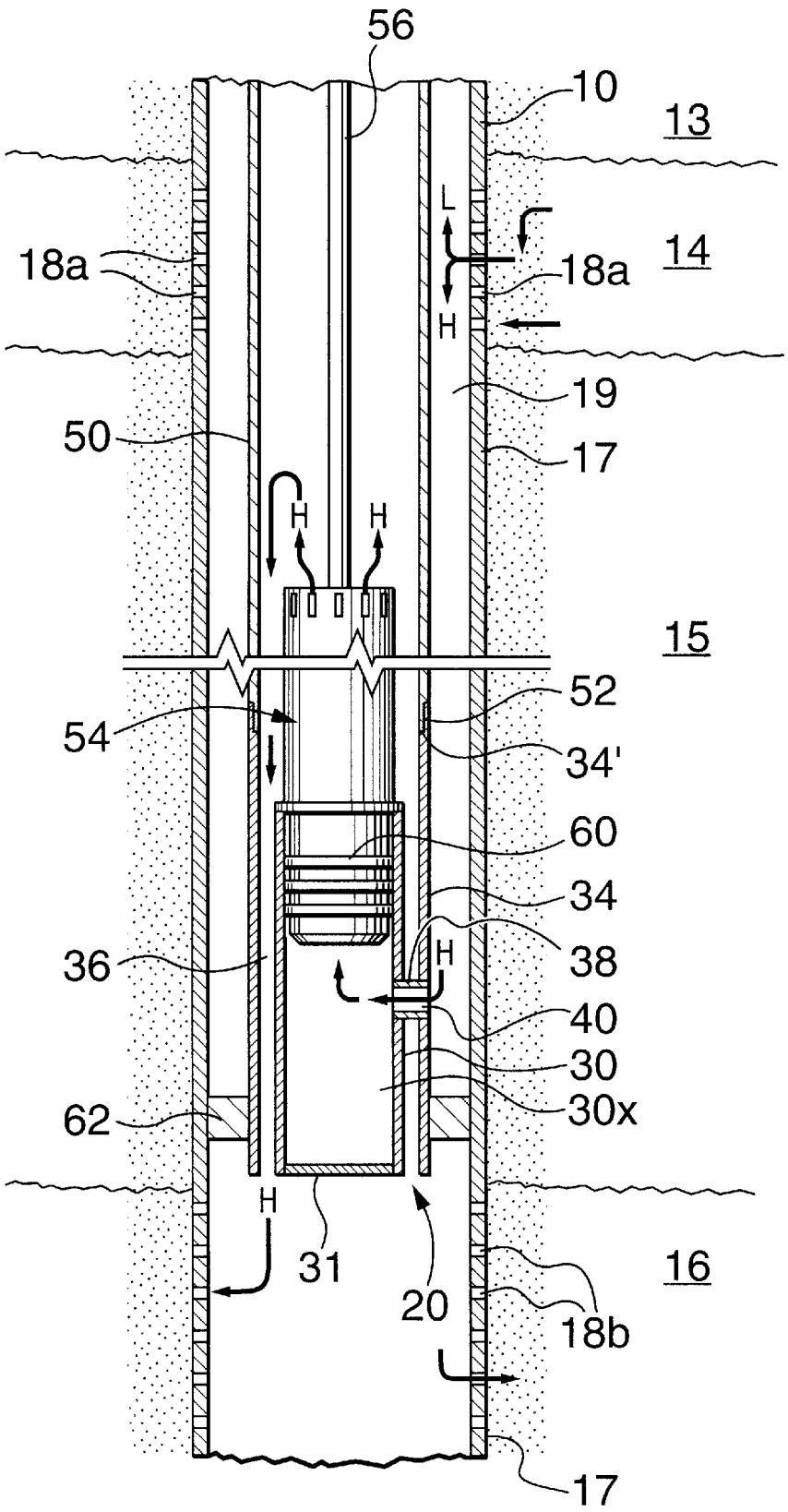
FIG. 1 shows a schematic representation of a vertical section along a cased borehole, the borehole having an injection tool disposed therein.

Referring to FIG. 1, a sectional schematic view along a well is shown. The well borehole, indicated at 10, passes from surface (not shown) through a formation including an upper layer (not shown), an impermeable rock layer 13 below the upper layer, a production layer 14, a second impermeable layer 15 and a disposal layer 16 of permeable rock. Borehole 10 is lined with a casing 17 and is completed to prevent interzonal migration in the casing annulus. Upper perforations 18*a* are formed in casing 17 to provide access from the casing tube to the production layer 14 and lower perforations 18*b* are formed in casing 17 to provide access to disposal layer 16. The production layer 14 produces both a desired lighter hydrocarbon fluid, such as oil and/or gas, and a heavier waste fluid, such as water. Both of the fluids pass from the production layer through perforations 18*a* into casing 17. After a suitable residence time in the casing, for example one minute, the lighter fluids, such as gas, will be separated from the heavier fluids by density and gravity. Lighter fluids, such as gas, will pass, due to density and pressure, up the borehole opening 19, as indicated by arrows L. Fluids such as oil may require active separation from the waste fluids and may further require active pumping up the borehole after they are separated from the heavier fluids. The heavier fluids will pass by gravity further down the borehole, as indicated by arrows H.

The injection tool according to the present invention is shown schematically in FIG. 1 and is generally indicated as 20.

Tool 20 includes an inner tube 30 having a longitudinal bore 30*x*. A wall 31 is formed at the lower end of bore 30*x* to seal off the bore at the lower end. Wall 31 can be formed integral with inner tube 30 or can be a plug or other sealing means. An outer tube 34 is mounted substantially concentrically about inner tube 30. Outer tube 34 is mounted in spaced relation from inner tube 30 such that an annulus 36 is formed therebetween. Inner tube 30 and outer tube 34 are mounted together and annulus 36 is formed by any desired process such as by milling along the length of a wall of a tube to form an inner tube and an outer tube which are connected and have an annulus therebetween. Alternately, and as shown in the depicted embodiment, spacers 38 are secured between inner tube 30, and outer tube 34, for example by welding or fasteners, to maintain the spacing between the tubes. Spacers 38 are disposed between the tubes such that annulus 36 is not at any point completely blocked off and an open longitudinal conduit is between the tubes through the annulus between the lower and upper ends of tubes 30, 34.

The tool also includes at least one transverse port 40 which extends between and connects the inner bore 30*x* of inner tube 30 to the outside of the tool without opening into the annulus 36. Each port 40 is formed in any suitable way, for example by placing a tube in sealing arrangement between an opening formed in inner tube 30 and an opening formed in outer tube 34. Where a spacer 38 is used to form annulus 36, port can be formed conveniently by drilling an opening through the spacer, as shown. In so doing, it is necessary that a seal be provided at the interface between the spacer and the tubes where the port passes to prevent passage of fluid from the port through the interface.

For use in the injection of waste fluids, tool 20 is preferably connected at its upper end into an upper tubing string 50. Tubing string 50 is connected in any suitable way to upper end 34' of outer tube 34, for example by threaded connections 52 or other means such as collars, welding or swedges.

A pump 54 is inserted within tubing string 50 and is attached to communicate with the inner bore 30*x* of inner tube 30. Pump 54 can be any suitable pump for downhole operation such as, for example, a rod pump, as shown, a progressing cavity pump or an electric submersible pump. When pump 54 is a rod pump, a pumping rod 56 extends from the surface between a reciprocating means (not shown), such as a pump jack, and the pump. As is known, reciprocating movement of the reciprocating means is translated to pump 54 through rod 56 to cause pump 54 to pump liquid. The pump is maintained in communication with the bore 30*x* of inner tube 30 by any suitable means such as, for example, hold down apparatus 60 which is engaged to the pump, such as by threaded attachment. Hold down apparatus is inserted into the longitudinal bore of inner tube 30 and is frictionally engaged therein. Alternately, pump can be engaged, directly or through a cross over or swedge, to the inner tube. This requires that a physical connection system be provided on the inner tube such as, for example a threaded connection or J-lock assembly which corresponds to that on the pump.

A sealing means 62, such as a packer, is provided about or below the tool to effect a seal between tube 34 and casing 17. The seal is required to be positioned between transverse port 40 and the lower opening of the annulus. The lower opening of the annulus can be, in effect, lowered by attaching a tube to the outer tube to extend it downwardly. Thus, the sealing means can be mounted about the outer tube or can be mounted on an extension tube attached to the outer tube, as by threaded connection, and extending below the tool. Sealing means 62 can be a packer or any other sealing means which can be placed around a tube to block passage of fluid about the tool and through the well bore. Preferably, the sealing means are retractible so that the well bore seal can be removed to permit removal of the tool from the well. For example, the sealing means can be an inflatable/deflatable packer or a mechanical packer.

As noted hereinbefore, tool 20 is useful for injecting heavier fluids to a disposal layer 16 below the tool. The tool is positioned below perforations 18*a* and the sealing means is set to seal between the tool and the casing. The heavier fluids move by gravity, arrow H, toward the tool. Sealing means 62 creates a seal between casing 17 and tool 20 so that heavier fluids accumulate around the tool and enter the tool through ports 40.

Pump 54 is driven to pump the fluids in through ports 40, up through bore 30*x* of the inner tube and up through pump 54. The liquids will spill out of pump 54 into the bore of tubing string 50 and will move by gravity down toward tool 20. When the liquid reaches the tool, it will pass through annulus 36 and out the lower end thereof into the casing 17 adjacent the disposal layer 16. The liquid will then flow through perforations 18*b* into the disposal layer.

Figure 2:
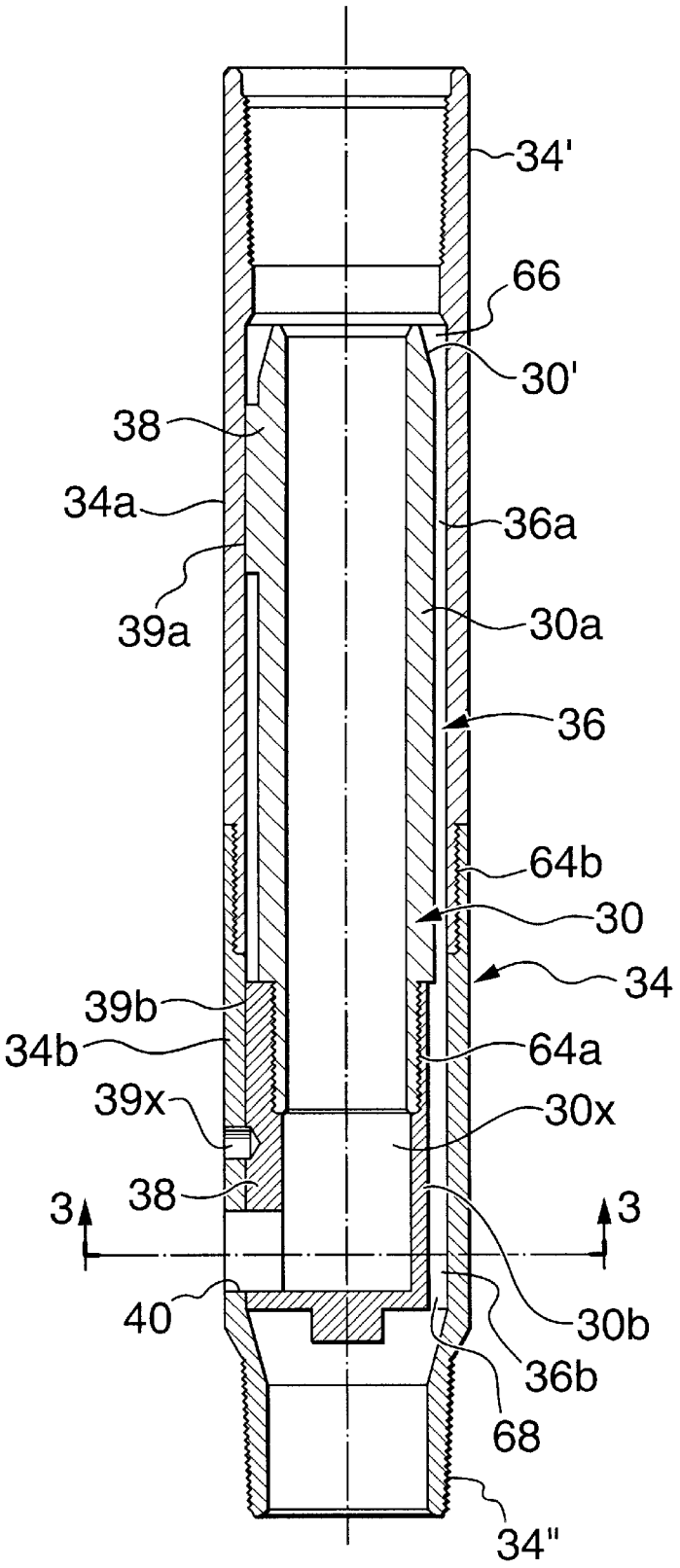
FIG. 2 shows a longitudinal section through an injection tool according to the present invention.
Figure 3:
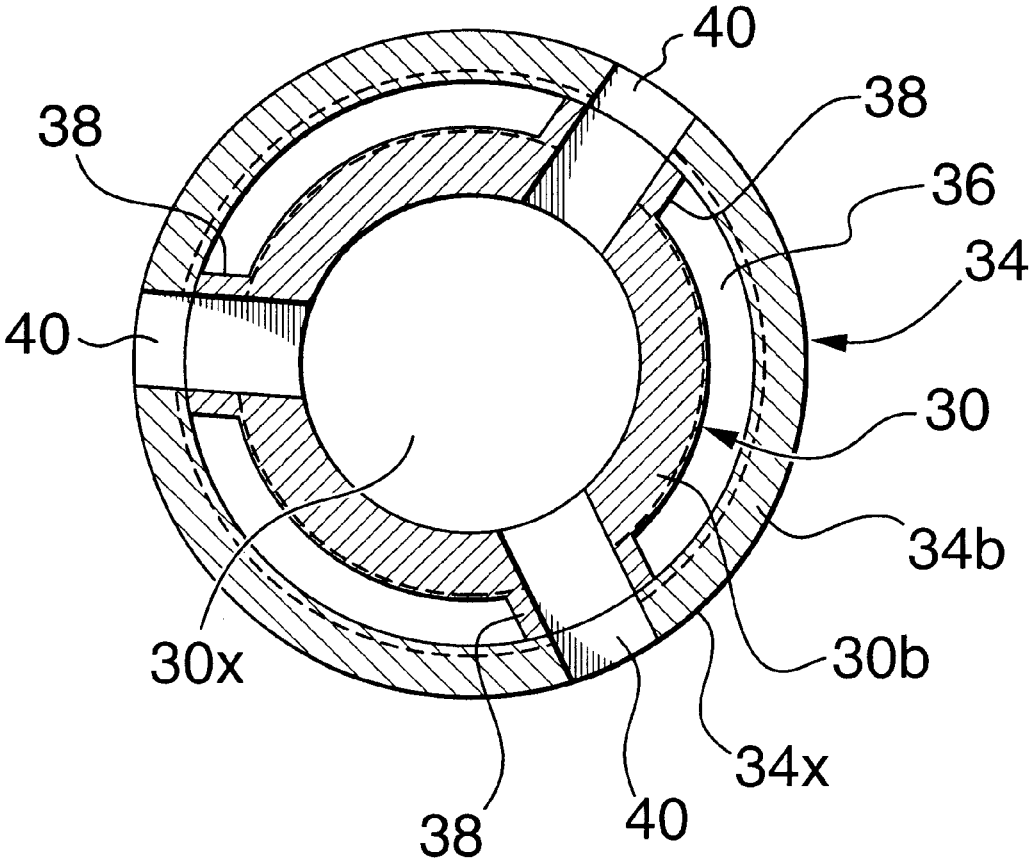
FIG. 3 is a cross sectional view along line 3—3 of FIG. 2.

Referring to FIGS. 2 and 3, a preferred embodiment of the tool is shown. Outer tube 34 is mounted about and spaced from inner tube 30. End 34' of tube 34 is formed for threaded connection into a tubing string, such as that shown as tubing string 50 in FIG. 1, and lower end 34" of tube 34 is formed for threaded connection to a lower extension tube (not shown) which attaches to a packer. Packers are known in the art.

Spacers 38 are positioned between the tubes. Preferably, spacers 38 are formed integral with inner tube 30 and outer tube 34 is attached, as by welding or any other suitable means, to at least some of spacers 38. Where welding is used, as indicated at 39*b*, slots 39*x* can be provided or formed in outer tube 34 to facilitate such welding. After welding the parts together, preferably, three ports 40 are formed, as by drilling, through the spacers to provide access between bore 30*x* of inner tube 30 and the outer surface 34*x* of outer tube 34. Weld 39*b* is preferably made such that it effects a seal at the interface between spacers 38 and outer tube 34 about ports 40. Where the weld or other means of attachment of the outer tube to the spacers does not provide a seal at the interface of the parts around the ports 40, other sealing means must be provided about the ports.

Annulus 36 is formed between the tubes 30, 34. Access to annulus 36 is provided at upper opening 66 and lower opening 68. In one embodiment, the minimum cross sectional area of the annulus is selected to correspond to the total cross sectional area of ports 40. (In the tool, as shown, the position where the annulus cross sectional area is at a minimum is shown in FIG. 3. This is the area where the transverse port walls extend through the annulus.) In particular, the total cross sectional area of ports 40 is selected to be between about 85% to 105% and, preferably, between about 95% to 105% of the minimum cross sectional area of the annulus. In a preferred embodiment, the total combined cross sectional area of the transverse ports is selected to be about equal to the minimum cross sectional area of the annulus. In a tool according to the present invention having a 3.5" diameter and suitable for use in a casing having a diameter of 4.5" or greater, the total combined cross sectional area of the ports is selected to be about 1.6 square inches (i.e. each of the ports has a cross sectional area of 0.53 square inches) and the minimum cross sectional area of the annulus is also about 1.6 square inches.

To facilitate flow of liquid into the annulus, preferably upper end 30' of inner tube is chamfered, as shown.

Erosion and the build up of scale in the liquid conduits of the tool has limited the useful life of prior art injection tools. To accommodate any wear due to erosion which will be experienced over the life of the tool, the minimum wall thicknesses of the outer tube, inner tube and transverse ports are selected to be greater than 0.18 inches and preferably are selected to be between about 0.23 and 0.27 inches. To reduce the effects of erosion and to reduce the accumulation of scale in the liquid conduits, preferably the interior of the transverse ports, the walls of the inner and outer tubes which define the annulus and the inner bore of the inner tube and preferably all surfaces of tool is coated with a material which is resistant to erosion and/or to the attachment of scale. A suitable material is, for example, a fluoropolymer such as, for example, Impreglon™. The coating material can be applied in any suitable way such as, for example, by spraying, dipping or painting.

An injection tool which is adaptable to accept various pump hold down apparatus or pump connections or other assemblies such as intake filters is desirable and is not previously known. The tool of FIG. 2 is useful in this way. The upper portion of the tool is formed to be detachable from the remainder of the tool and is, thereby, replaceable. In particular, inner tube 30 is formed as an upper inner tube 30*a* and a lower inner tube 30*b*. Upper inner tube 30*a* and lower inner tube 30*b* are releasably connected at a connection 64*a*, preferably by threading, which is disposed above ports 40. Outer tube 34 is formed as an upper outer tube 34*a* and a lower outer tube 34*b* which are releasably connected at connection 64*b*, preferably by threading. Connection 64*b* is also positioned above ports 40. Lower outer tube 34*b* is mounted about lower inner tube 30*b* and an annulus 36*b* is formed therebetween. Tubes 30*a* and 34*a* align with tubes 30*b* and 34*b*, respectively, and are sealably connectable at connections 64*a*, 64*b*, respectively. When the upper tubes 30*a* and 34*a* are connected at connections 64*a*, 64*b* to the lower assembly, an annulus 36*a* is formed therebetween and annulus 36*a* opens into annulus 36*b*. Preferably, upper inner tube 30*a* and upper outer tube are not connected at interface 39*a*, such that upper inner tube 30*a* and upper outer tube 34*a* can each be removed independently from the assembly of the lower outer tube and the lower inner tube. Spacers 38 are preferably attached on upper inner tube 30*a* to provide for centralization and stability of the upper inner tube within the upper outer tube.

A tool which has a removable upper portion, as shown, permits that various upper sections can be produced having as an example a) inner tubes with various inner diameters selected to accept hold down apparatus having selected different outer diameters, b) inner tubes of selected lengths (i.e. 6 to 12 inches) to accommodate various types of pump filters, c) inner tubes with threaded connections at their upper end for connection to a pump or d) combinations of any of the foregoing. These upper sections, which cost less to manufacture that the ported lower section, can be attached to and detached from the lower section and replaced, as desired for the selected application for which the tool is to be used. Alternately, the upper portion of the inner tube can be removed altogether and a pump can be threaded directly to lower inner tube 30*b*. Thus, the usefulness of the tool is increased over one-part tools.

The tool of FIGS. 2 and 3 can have attached thereto an upper tubing string, a pump assembly and a sealing means and can be used in the same manner as was described with reference to FIG. 1.

In an embodiment, the minimum cross sectional area of the annulus is selected to correspond to the discharge area of the pump which is intended to be attached to the tool. In particular, the minimum cross sectional area of the annulus is selected to be at least 90% of the discharge area of the pump. As an example, for use with a pump having a 1.23 square inch to 1.77 square inch discharge area (for example a standard 1.25 to 1.5 inch pump), a preferred tool has an annulus with a minimum cross sectional area of 1.6 to 1.77 square inches. Preferably, the tool is selected such that the minimum cross sectional area of the annulus is substantially equal to or greater than the discharge area of the pump with which it is to be used. A tool which is selected with consideration to the pump to correspond with the pump discharge reduces the load on the pump and on any seals in the system and addresses pressure and velocity concerns inherent with the use of prior art injection tools.

Figure 4:
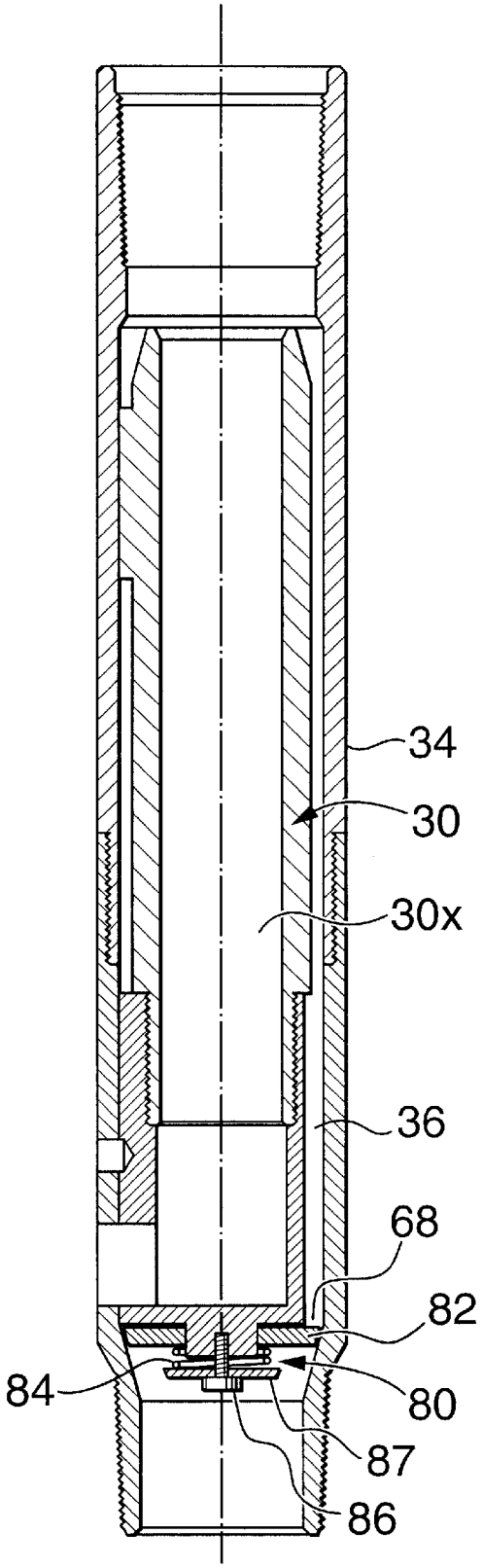
FIG. 4 shows a longitudinal section through another injection tool according to the present invention.

Referring to FIG. 4, another tool according to the present invention is shown. In the illustrated embodiment, a valve 80 is provided at the lower opening 68 of annulus 36. Valve 80 is normally closed but can be opened by application of a selected degree of force, such as the weight of a column of water, applied to the valve from within annulus 36. In particular, valve 80 can include, for example, a sealing flange 82 positioned to cover and seal against opening 68 of annulus 36, a biasing means 84 such as a coil spring for biasing flange 82 against the opening and a screw 86 and a washer 87, or other valve mounting means, for securing the valve assembly in position at the bottom of the tool. The valve can be according to that illustrated or any other pressure actuated valve, for example, a flapper valve or a ball and seat type valve.

The tool of FIG. 4 is particularly useful with an electrically driven pump. The valve is selected to create a build up of water in the pump so that a water load is placed on the pump. As is known, the electrical consumption of the pump can be monitored to determine if there exists a water load on the pump. When no water load is detected, it can be determined that the pump is operating dry and can be shut down.

It will be apparent that many other changes may be made to the illustrative embodiments, while falling within the scope of the invention and it is intended that all such changes be covered by the claims appended hereto.

The embodiments of the invention in which an exclusive property or privilege is claimed are defined as follows:

1. A downhole tool comprising: an inner tube having a longitudinal bore with a lower end, a seal disposed at the lower end of the longitudinal bore, an outer tube having an outer surface and an upper end and being attached about and spaced from the inner tube; an annulus formed between the inner tube and the outer tube and being open at each end; means at the upper end of the outer tube to connect the outer tube to a tubing string such that the annulus opens into the tubing string's longitudinal bore and a transverse port extending to provide access between the longitudinal bore of the inner tube and the outer surface of the outer tube without opening into the annulus, the inner tube being formed of an upper inner tube and a lower inner tube, the upper inner tube and the lower inner tube being connectable to form a fluid tight seal therebetween and the upper inner tube being removable from the remainder of the tool.

2. The downhole tool as defined in claim 1 wherein the seal in the longitudinal bore is an end wall formed integral with the inner tube.

3. The downhole tool as defined in claim 1 wherein the seal in the longitudinal bore is a plug secured in the bore of the inner tube.

4. The downhole tool as defined in claim 1 further comprising a coating of non-stick and/or erosion resistant material applied to at least some of the surfaces of the tool.

5. The downhole tool as defined in claim 4 wherein the coating material is a fluoropolymer.

6. The downhole tool as defined in claim 1 further comprising a coating of non-stick and/or erosion resistant material applied to at least those surfaces defining the transverse port, the longitudinal bore of the inner tube and the annulus.

7. The downhole tool as defined in claim 1 wherein the inner tube is preferably selected to have a length suitable for accommodating a pump filter therein.

8. The downhole tool as defined in claim 1 wherein the inner tube of the tool includes means for engagement to a pump.

9. The downhole tool as defined in claim 8 wherein an end of the inner tube opposite its lower end is threaded.

10. The downhole tool as defined in claim 1 wherein the upper inner tube is formed for accepting a pump.

11. The downhole tool as defined in claim 1 wherein the outer tube is formed as an upper outer tube and a lower outer tube, the upper outer tube and the lower outer tube being connectable to form a fluid tight seal therebetween, the upper inner tube and the upper outer tube being removable from the remainder of the tool.

12. The downhole tool as defined in claim 1 further comprising a valve on the tool to regulate the flow of fluid out of the annulus.

13. The downhole tool as defined in claim 1 wherein the transverse port of the tool is selected such that its total minimum cross sectional area is between about 85% to 105% of the minimum cross sectional area of the annulus.

14. The downhole tool as defined in claim 1 wherein the lower inner tube is formed for accepting a pump.

15. The downhole tool as defined in claim 1 wherein the lower inner tube is threaded for connection to a pump.

16. The downhole tool as defined in claim 1 wherein the transverse port passes through the lower inner tube.

17. A downhole assembly for passing waste fluids through a well borehole from a production layer to a disposal layer, the well borehole having a wall extending from surface, the assembly comprising:

a tool including an inner tube having a longitudinal bore with a lower end, a seal disposed at the lower end of the longitudinal bore, an outer tube having an upper end and an outer surface and being mounted about and spaced from the inner tube; an annulus formed between the inner tube and the outer tube and being open at each end; means at the upper end of the outer tube to connect the outer tube to a tubing string such that the annulus opens into the tubing string's longitudinal bore and a transverse port extending to provide access between the longitudinal bore of the inner tube and the outer surface of the outer tube without opening into the annulus, the inner tube being formed of an upper inner tube and a lower inner tube, the upper inner tube and the lower inner tube being connectable to form a fluid tight seal therebetween and the upper inner tube being removable from the remainder of the tool;

a tubing string connected to the upper end of the outer tube; and a pump, having a known discharge area, in pumping communication with the longitudinal bore of the inner tube.

18. The downhole assembly of claim 17 wherein the tool is selected to have an annulus with a minimum cross sectional area substantially equal to 90% or more of the cross sectional area of the pump discharge area.

19. The downhole assembly of claim 17 wherein the minimum cross sectional area of the annulus is substantially equal to greater than the cross sectional area of the pump discharge area.

20. The downhole assembly of claim 17 further comprising a sealing means disposed in association with the tool to be capable of creating a seal between the tool and borehole wall between the transverse port and the lower opening to the annulus.

21. The downhole assembly of claim 17 wherein the sealing means is attached to the tool.

22. The downhole assembly of claim 17 wherein the sealing means is mounted on an extension tube attached to and extending below the outer tube.

23. A method for passing waste fluids through a well borehole from a production layer to a disposal layer, the well borehole having a wall extending from surface, comprising:

providing a downhole tool including an inner tube having a longitudinal bore with a lower end, a seal disposed at the lower end of the longitudinal bore, an outer tube having an outer surface and an upper end and being mounted about and spaced from the inner tube; an annulus formed between the inner tube and the outer tube and being open at each end; means at the upper end of the outer tube to connect the outer tube to a tubing string such that the annulus opens into the tubing string's longitudinal bore and a transverse port extending to provide access between the longitudinal bore of the inner tube and the outer surface of the outer tube without opening into the annulus, the inner tube being formed of an upper inner tube and a lower inner tube, the upper inner tube and the lower inner tube being connectable to form a fluid tight seal therebetween and the upper inner tube being removable from the remainder of the tool;

connecting the outer tube to a tubing string;

placing a pump in pumping communication with the longitudinal bore of the inner tube;

positioning the tool, tubing section and the pump in the borehole such that the tool is in pumping communication with waste fluids passing from the production zone;

setting a sealing means about the tool between the transverse port and the lower opening to the annulus; and activating the pump to move waste fluids in through the transverse port and through the inner tube bore.

24. The method as defined in claim 23 wherein the sealing means is attached to the tool.

25. The method as defined in claim 23 wherein the sealing means is mounted on an extension tube attached to and extending below the outer tube.

26. A downhole tool comprising: a tubular member having a wall formed of an inner wall section and an outer wall section and at least one unobstructed longitudinal conduit extending between the inner wall section and the outer wall section from one end of the tubular member to the other and at least one transverse port extending through the wall of the tubular member without intercepting any longitudinal conduit; means to connect the tubular member to a tubing section wherein the at least one longitudinal conduit opens at one end into the tubing section's inner bore and a seal at one end of the tubular member, the improvement comprising: the inner wall section being formed of an upper portion and a lower portion, the upper portion and the lower portion being connectable to form a fluid tight seal therebetween and the upper portion of the inner wall section being removable from the remainder of the tool.

27. The downhole tool as defined in claim 26 wherein the upper portion of the inner wall section is formed for accepting a pump.

28. The downhole tool as defined in claim 26 wherein the lower portion of the inner wall section is formed for accepting a pump.

29. The downhole tool as defined in claim 26 wherein the lower portion of the inner wall section is threaded for connection to a pump.

30. The downhole tool as defined in claim 26 wherein the outer wall section is formed as an upper outer portion and a lower outer portion, the upper outer portion and the lower outer portion being connectable to form a fluid tight seal therebetween, the upper portion of the inner wall section and the upper outer portion being removable from the remainder of the tool.

31. A downhole tool comprising: an inner tube having a longitudinal bore with a lower end, a seal disposed at the lower end of the longitudinal bore, an outer tube having an outer surface and an upper end and being attached about and spaced from the inner tube; an annulus formed between the inner tube and the outer tube and being open at each end; means at the upper end of the outer tube to connect the outer tube to a tubing string such that the annulus opens into the tubing string's longitudinal bore and a transverse port extending to provide access between the longitudinal bore of the inner tube and the outer surface of the outer tube without opening into the annulus, the outer tube being formed as an upper outer tube and a lower outer tube, the upper outer tube and the lower outer tube being connectable to form a fluid tight seal therebetween and the upper outer tube being removable from the remainder of the tool.

32. The downhole tool as defined in claim 31 wherein the inner tube is formed of an upper inner tube and a lower inner tube, the upper inner tube and the lower inner tube being connectable to form a fluid tight seal therebetween and the upper inner tube being removable from the remainder of the tool.

33. The downhole tool as defined in claim 31 wherein the transverse port passes through the lower outer tube.

34. A downhole assembly for passing waste fluids through a well borehole from a production layer to a disposal layer, the well borehole having a wall extending from surface, the assembly comprising:

a tool including an inner tube having a longitudinal bore with a lower end, a seal disposed at the lower end of the longitudinal bore, an outer tube having an upper end and an outer surface and being mounted about and spaced from the inner tube; an annulus formed between the inner tube and the outer tube and being open at each end; means at the upper end of the outer tube to connect the outer tube to a tubing string such that the annulus opens into the tubing string's longitudinal bore and a transverse port extending to provide access between the longitudinal bore of the inner tube and the outer surface of the outer tube without opening into the annulus, the inner tube being formed of an upper inner tube and a lower inner tube, the upper inner tube and the lower inner tube being connectable to form a fluid tight seal therebetween and the upper inner tube being removable from the remainder of the tool;

a tubing string connected to the upper end of the outer tube; and a pump, having a known discharge area, in pumping communication with the longitudinal bore of the inner tube.

35. The downhole assembly as defined in claim 34 wherein the outer tube is formed of an upper outer tube and a lower outer tube, the upper outer tube and the lower outer tube being connectable to form a fluid tight seal therebetween and the upper outer tube being removable from the remainder of the tool.

* * * * *